US010914031B2

(12) United States Patent
Piekarski et al.

(10) Patent No.: US 10,914,031 B2
(45) Date of Patent: Feb. 9, 2021

(54) LAUNDRY WASHING MACHINE COMPRISING AN AGITATOR

(71) Applicant: Electrolux Do Brasil S.A., Curitiba (BR)

(72) Inventors: Marcelo Piekarski, Curitiba (BR); Luiz Carlos Pazinato, Curitiba (BR); Fabiano Costi, Curitiba (BR); Oscar Luiz Madalena, Curitiba (BR); Eduardo Orthmann, Curitiba (BR); Eduardo De Menezes Lino Modesto, Curitiba (BR); Vicente Marconcin Vanhazebrouck, Curitiba (BR); Adriano Bonatto Cardozo, Curitiba (BR)

(73) Assignee: Electrolux do Brasil S.A.

( * ) Notice: Subject to any disclaimer, the term of this patent is extended or adjusted under 35 U.S.C. 154(b) by 226 days.

(21) Appl. No.: 15/959,989

(22) Filed: Apr. 23, 2018

(65) Prior Publication Data

US 2018/0313024 A1 Nov. 1, 2018

(30) Foreign Application Priority Data

Apr. 27, 2017 (BR) ..... 10 2017 008929

(51) Int. Cl.

| | |
|---|---|
| ***D06F 39/10*** | (2006.01) |
| ***D06F 39/08*** | (2006.01) |
| *D06F 13/02* | (2006.01) |

(52) U.S. Cl.

CPC ..... *D06F 39/10* (2013.01); *D06F 39/088* (2013.01); *D06F 13/02* (2013.01); *D06F 39/083* (2013.01)

(58) Field of Classification Search

CPC ..... D06F 39/10

See application file for complete search history.

(56) References Cited

U.S. PATENT DOCUMENTS 2,976,711 A 3/1961 Smith

FOREIGN PATENT DOCUMENTS

| | | | |
|---|---|---|---|
| BR | 102012030892 | A2 | 9/2014 |
| JP | 60111692 | A | 6/1985 |
| MU | 88025241 | U2 | 7/2010 |
| MU | 91031516 | U2 | 12/2015 |

*Primary Examiner* — Jason Y Ko

(74) *Attorney, Agent, or Firm* — RatnerPrestia

(57) ABSTRACT

A laundry washing machine having a washing basket that is loaded through the upper area, and an agitator located inside the washing basket. The agitator has a base, a hollow elongated body provided with at least one opening, and a filtration element located within the agitator. The agitator has a plane defined by the intersection of at least two areas of the edge of the opening to form an angle, relative to a tangential velocity vector of the rotational movement of the agitator starting from said opening, the angle being defined between 15° and 90°.

17 Claims, 11 Drawing Sheets

LAUNDRY WASHING MACHINE COMPRISING AN AGITATOR

This application claims the benefit of and priority to Brazil Patent Application No. 10 2017 008929-0, filed Apr. 27, 2017, which is incorporated by reference herein.

FIELD OF THE INVENTION

This invention pertains to the field of household utensils and laundry washing machines and relates to a laundry washing machine comprising an agitator. More specifically, this invention relates to a laundry washing machine provided with an agitator which improves the admission of washing liquid to the area for filtration and retention of lint suspended in the washing medium inside the laundry washing machine's basket.

BACKGROUND OF THE INVENTION

Laundry washing machines are household, commercial or industrial equipment widely employed to assist in the task of cleaning garments or fabrics in general, due to their practicality and time-saving features provided to the user.

Laundry washing machines are usually provided with a main cabinet, a washing basket and an agitator arranged inside the washing basket, the latter responsible for providing the agitation to the laundry inside the basket.

The agitator comprises at least one base and an elongated body situated on said base, so that a rotating movement, in general (but not necessarily) alternating movement of the agitator about a rotating center promotes agitation of the washing liquid and causes textile articles loaded inside the washing basket to be cleaned properly.

Washing liquid is understood to be a mixture of water and any type of soap, bleach, fabric softener or laundry compounds, blended at any ratio. Furthermore, textile articles are understood to mean any type of clothing, towels, sheets or other articles composed of textile material which one wishes to wash with the aid of a laundry washing machine.

The agitator has a base upon which a hollow elongated body is associated. As is known to those skilled in the art, the agitator base has radial vanes that promote the directioning of the washing liquid towards the radial direction and this movement generates an upward flow in the outermost part of the basket and in a downward movement in the central area of said washing basket. The washing liquid that descends in the central area of the washing basket accesses the hollow inner area of the elongated body of the agitator through openings located in its wall.

Said openings in the outermost wall of the elongated body of the agitator are arranged in a radial direction so that the flow of washing liquid enters the internal area of the agitator by means of the pressure difference generated by the movement of the agitator, taking a downward direction within the elongated body of the agitator.

Agitation of the washing liquid and the promoted friction on the garments causes lint to be detached from the fabric being washed. The accumulation of lint and grime inside the washing basket made it necessary to develop filters which were able to keep the washing liquid as clean as possible.

Such filters have already been placed in laundry washing machines in the most varied ways. At the beginning of the development of these filtering devices, the manufacturers used a pump to circulate the washing liquid and force it through said filtration elements. As the technique developed, the filtration elements were inserted into the agitator and various devices were developed so that the washing liquid was circulated inside the agitator and the filtration was not compromised.

An example of a washing machine having a filtration system inserted into the agitator is disclosed by the document JPS60111692. This document discloses an agitator comprising openings in its elongated portion and located in a washing basket. The reciprocating rotational movement of the agitator generates centrifugal forces in the washing liquid and causes said liquid from being in the inner part of the basket to move in the radial direction of said basket and, as it approaches the basket wall, the liquid turns in an upward direction. The movement of the washing liquid generated within the washing basket causes a downward movement of the washing liquid in the most central part of the washing basket where the agitator is positioned which is provided with a filtering system therein. The technique disclosed by the document JPS60111692 has been widely used in today's laundry washing machines as it does not require a pump to promote the filtering of lint and grime that have been detached from the washed garments and fabrics.

U.S. Pat. No. 2,976,711 discloses a development analogous to that proposed by the document JPS60111692 and demonstrates that this technique has already been widely explored at a given time.

With the increased capabilities of current laundry washing machines and the need for faster washing, the use of only the forces generated by the agitator base has slowed down the development of this area of the technique as the washing liquid becomes saturated with impurities faster than the filtration systems can remove the dirt.

In an attempt to improve the filtration efficiency of the wash liquid, developers of laundry washing machines have proposed improvements in laundry filters. Some of these improvements are disclosed in the documents BR102012030892, MU9103151-6 and MU8802524-1 which present different forms and constructive arrangements for the filters, in order to increase the filtration area, changing the means of attachment and even the means to facilitate removal and cleaning of the filters.

However, it is noted that the Prior Art does not provide an effective means for increasing the washing flow circulating through the filtration elements. Thus, there is a need to promote a better flow of the washing liquid through the interior of the agitator and hence through the filter within the agitator to cause less lint and grime to be mixed into the garments and fabrics being washed.

OBJECTIVES AND DESCRIPTION OF THE INVENTION

Thus, it is an object of this invention to improve circulation of the washing liquid inside the washing basket.

A further object of this invention is to improve the filtration capacity of the stream of washing liquid.

One or more objects of this invention mentioned above, among others, are achieved by a laundry washing machine comprising an agitator located inside the washing basket of a laundry washing machine, provided with openings for admitting the washing liquid to the filtration area, which is provided with a plane defined by the intersection of at least two areas of the rim of the opening, thus forming an angle, with respect to a tangential velocity vector of the generally (but not necessarily) alternating rotational movement of the agitator starting from said opening, wherein the angle is defined between 15° and 90°, preferably between 30° and 90°. Further in particular, said plane is defined by the intersection of at least two areas of the edge of the opening opposite each other.

Other ranges of angle variation can be set between: 20° and 90°; 30° and 90°; 40° and 90°; 50° and 90°; 60° and 90°; 70° and 90°; or 80° and 90°.

In other words, the agitator comprises the intake openings for the filtration area, located within said agitator, oriented relative to the reciprocating rotational directions of the agitator, admitting the washing liquid as the agitator moves.

One or more objects of this invention are also achieved because the elongated body is provided with external projections situated in a direction ranging from 0 to 89° relative to a plane passing through the center of rotation of the agitator.

One or more objects of this invention are also achieved because the elongated body is provided with arched outer projections, the opening being located adjacent to the base of the inner area of the outer projection.

One or more objects of this invention are also achieved because the elongated body has a cross section perpendicular to the axis of rotation of the agitator with a peripheral area formed by two circumscribed circles and of different diameters. Each of these are interlocked at a quarter of the diameter of the peripheral portion of each of the cross-sections of the elongated body.

One or more objects of this invention are also achieved because the elongated body has a cross section perpendicular to the axis of rotation of the agitator with a peripheral area formed by two flat sides and two arched sides, with each of the portions being arranged in an interlocked fashion in each quarter of the peripheral portion.

One or more objects of this invention are also achieved because the elongated body has a cross section perpendicular to the axis of rotation of the peripheral area agitator wherein each quadrant comprises the arched portion offset toward the center of rotation of the agitator.

One or more objects of this invention are also achieved because the agitator has a plurality of openings located along its length.

One or more objects of this invention are also achieved because the agitator comprises pairs of rows of openings along the elongated body, the openings of each row being oriented in opposite directions.

One or more objects of this invention are also achieved due to the fact that the agitator comprises a filtration element therein, in particular the openings being adjacent to the inlets of the filtration element.

In particular, the openings of the filtration element comprise a plane defined by the intersection of at least two areas of the edge of the opening forming an angle with a tangential velocity vector of the alternating rotational movement of the agitator starting from said opening, the angle being defined between 15° and 90°.

Other ranges of angle variation can be set between: 20° and 90°; 30° and 90°; 40° and 90°; 50° and 90°; 60° and 90°; 70° and 90°; or 80° and 90°.

One or more objects of this invention are also achieved in that the base of the agitator comprises a plurality of base openings, in particular the base being provided with openings located on the radial periphery of the agitator base.

Specifically, the washing machine that can be accommodated by this invention is of the type having the axis of the agitator upright and loaded through the top.

This invention relates to the arrangement of the openings of the elongated body of the agitator being positioned in a direction that improves the flow intake of the washing liquid, increasing the volume of washing liquid through the filtration element and, consequently, improving the efficiency of system filtering.

If the opening area is located in a perpendicular direction relative to the direction of the tangential speed of the rotor, such openings promote better admission of the washing liquid into the agitator. This is due to the alternating rotational movement of the agitator around a center of rotation which is noted as a tangential movement at the end of the elongated body of the agitator. This movement causes the washing liquid to be admitted directly into the agitator due to the alternating rotational movement.

However, there is nothing to prevent the openings in the elongated body of the agitator from being arranged in a direction other than that perpendicular to the radial direction, even though this is not the most efficient solution for drawing the washing liquid into the agitator body.

This invention also provides for the use of other geometries that promote improved suction of washing liquid into the agitator.

A further object of this invention is achieved by combining a filter located within the agitator, the filter having at least one opening aligned with the agitator openings so that the washing liquid passes through the agitator opening, entering the filter immediately.

BRIEF DESCRIPTION OF THE DRAWINGS

The objectives, technical effects and advantages of this invention will be apparent to those skilled in the art from the following detailed description with reference to the accompanying Figures, which illustrate exemplary but not limiting embodiments of the invention.

FIG. 7*b* depicts this effect when the reciprocating rotational movement is counterclockwise.

DESCRIPTION OF EMBODIMENTS OF THE INVENTION

Initially, it should be pointed out that the laundry washing machine comprising an agitator, object of this invention, will be described below according to particular but not limiting embodiments, since its embodiment may be realized in different shapes and variations and according to the application desired by the technician in the art.

In order to achieve the proposed objects, this invention discloses an agitator 10 for laundry washing machines of the type which is loaded through the upper area and which comprises a washing basket. The agitator 10 is located inside the washing basket and carries out an alternating rotary movement M about a center of rotation TC.

Figure 1:
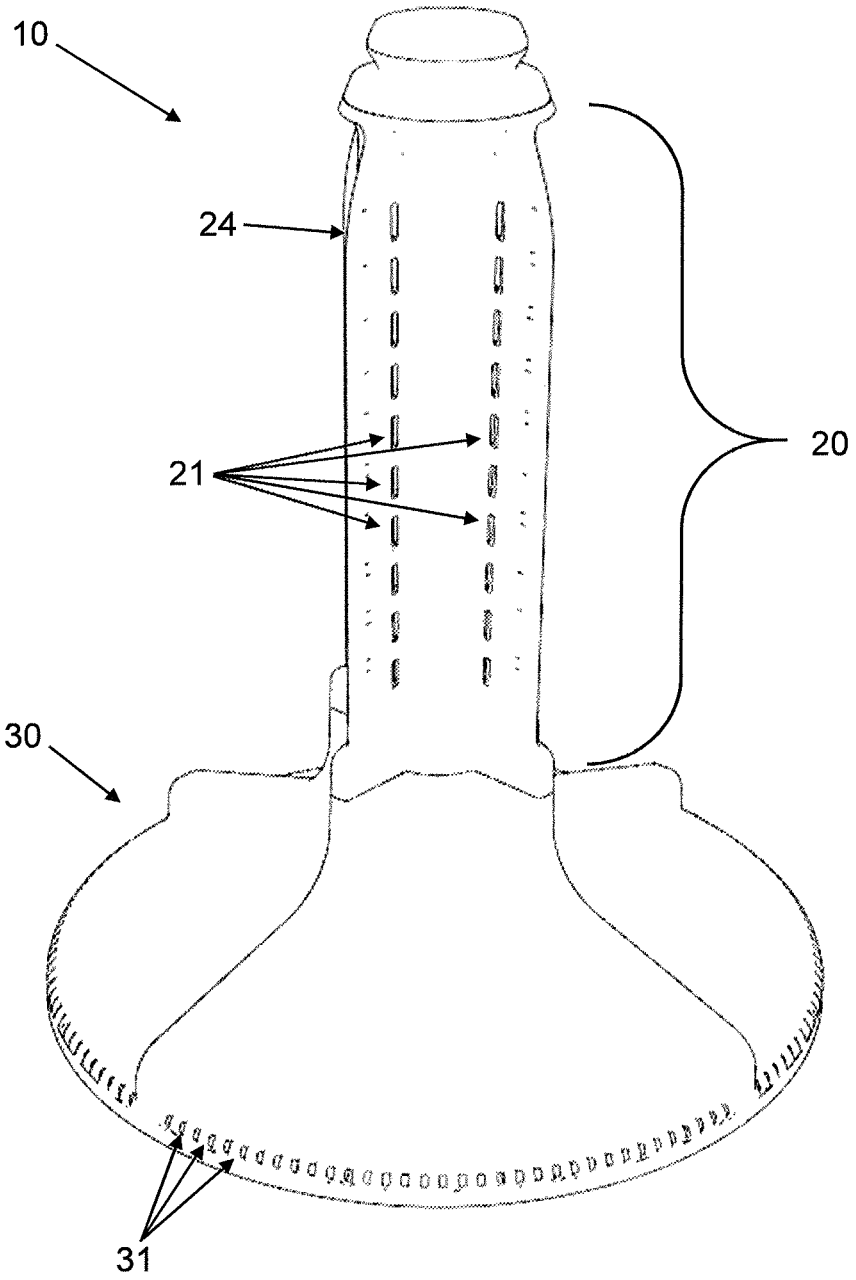
FIG. 1 shows an agitator for laundry washing machines comprising base and elongated body, in accordance with one embodiment of this invention.
Figure 2:
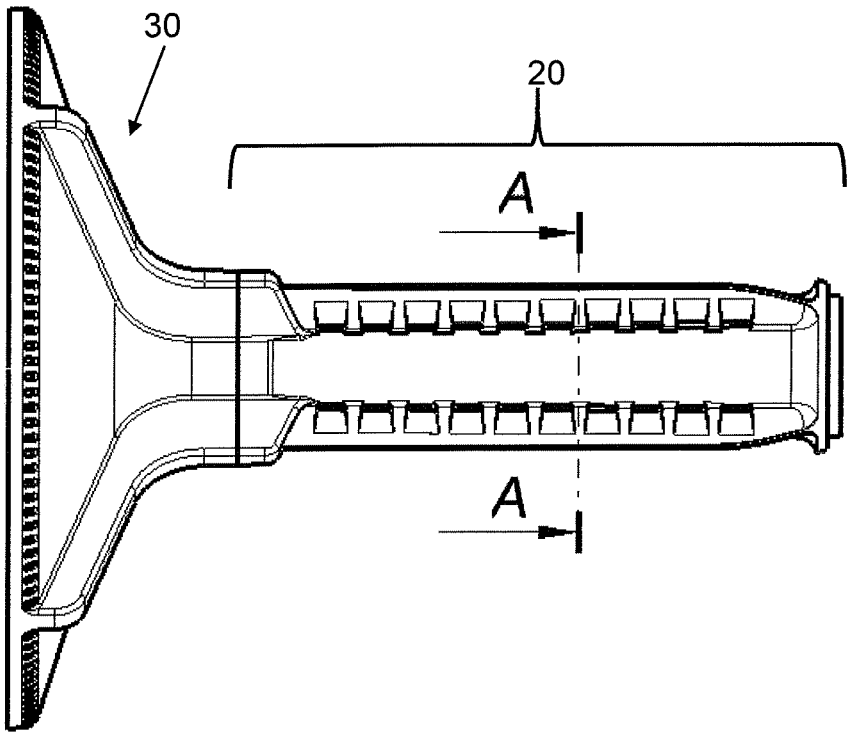
FIG. 2 shows a side view of the agitator shown in FIG. 1, indicating a cross-section at A-A.

As shown in FIG. 1, the agitator 10 of this invention comprises a base 30 and a hollow elongated body 20 provided with at least one opening 21 to admit washing liquid into the agitator, and consequently its passage through the filtration element 15, as the elongated hollow body 20 extends along a vertical axis.

Each opening 21 is defined by a passage communicating between the inner and outer area of the agitator 10, so that each opening 21 comprises an edge whose contour comprises geometry defined according to the design of the constructional characteristics desired. For each opening 21, a plane P is adopted which is defined by the intersection with at least two areas of the edge of said opening 21. In order to achieve the object of this invention, said plane P is offset with respect to the tangential velocity vector $v_{tan}$ of the alternating rotary motion M performed by the agitator at an angle β having a value ranging from 1° to 90°, and preferably from 30° to 90°, more preferably 90°.

Figure 6A:
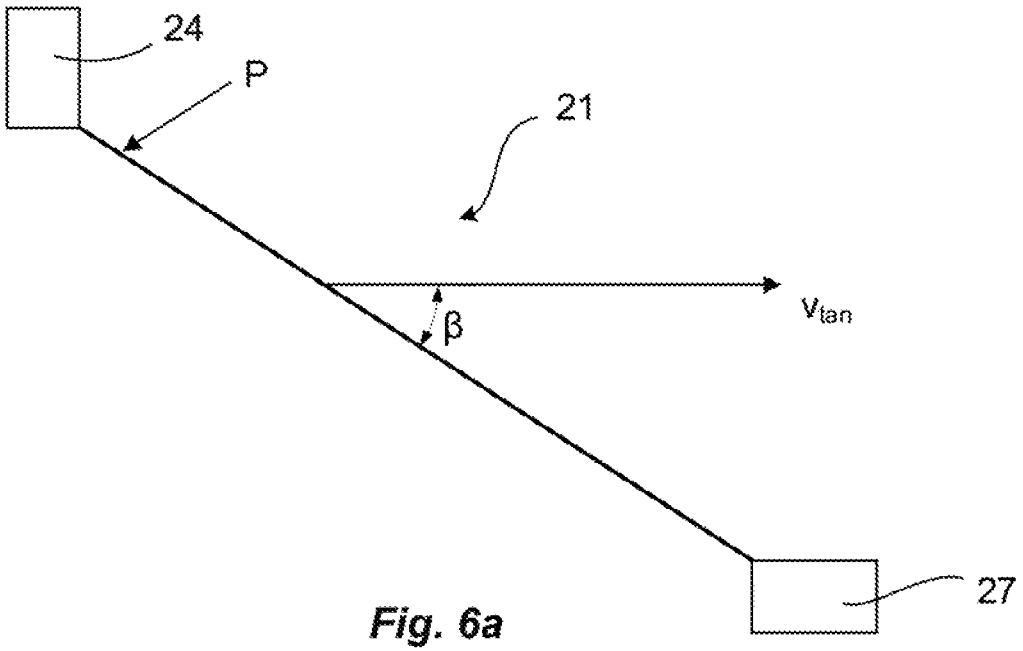
FIGS. 6*a* and 6*b* show two schematic representations of the relationship between the plane formed by the intersection of at least two edge areas of an agitator opening with the tangential velocity vector relating to the alternating rotational movement performed by the agitator during its operation, defining the angle β.
Figure 6B:
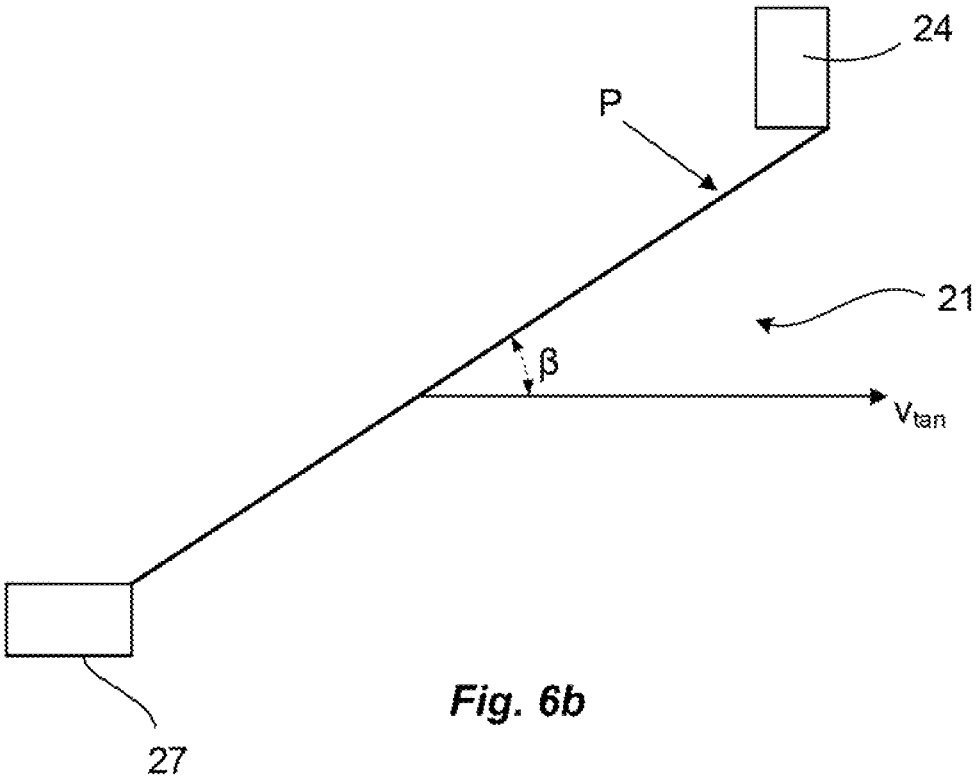
Figure 7A:
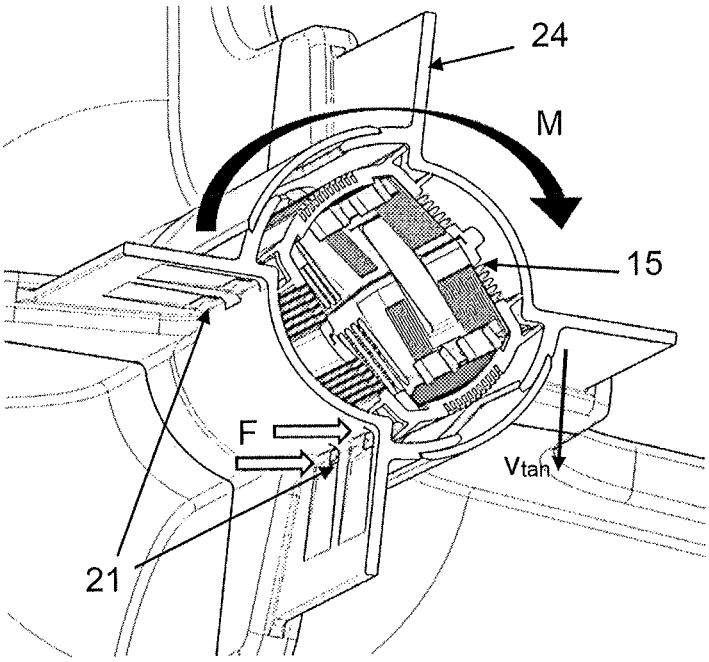
FIGS. 7*a* and 7*b* depict one embodiment of the agitator of this invention, shown in cross-section, in the condition that the wash liquid is admitted into the agitator as a function of the alternating rotational movement, FIG. 7*a* depicting this effect as the movement is in a clockwise direction.
Figure 7B:
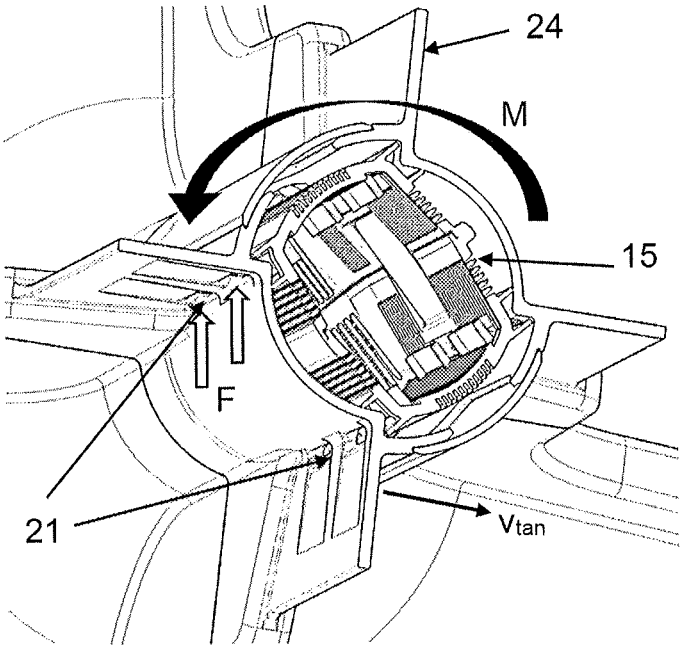

The definition of the angle β is intended to ensure that the opening 21 will be oriented so that the intake of the washing liquid will be increased as a function of the actual alternating rotary movement M performed by the agitator 10. Thus, a flow F of washing liquid is admitted with high efficiency, once the intake opening 21 admits the washing liquid immediately in front thereof, when the rotational movement M of the agitator is performed. FIGS. 6*a* and 6*b* exemplify two valid conditions according to this invention, with two different slopes of the plane P being shown with respect to the vector of the tangential velocity $v_{tan}$, defining the reference angles β for the positioning of the openings 21.

In order to optimize the agitation of the washing liquid, the agitator 10 further comprises a plurality of outer projections 24, located along the length of the agitator 10.

Figure 4:
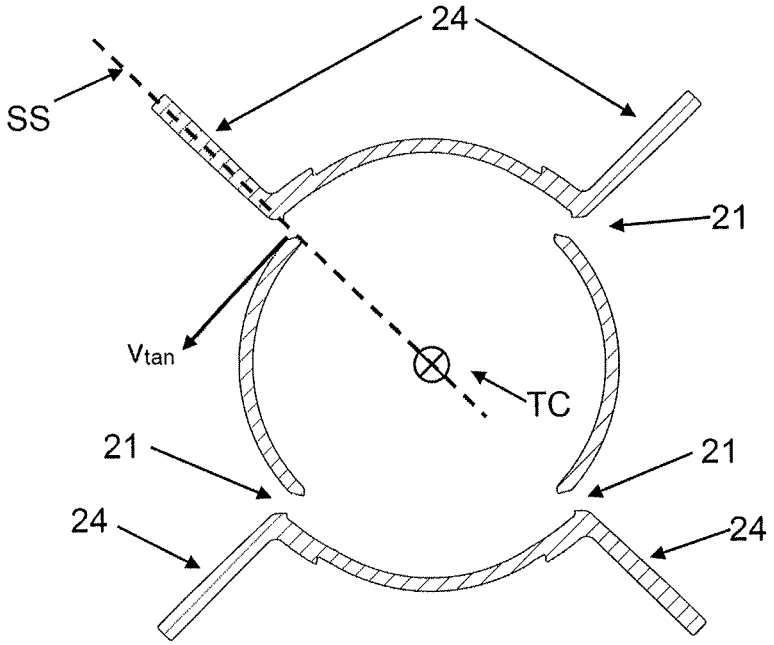
FIG. 4 shows a cross-sectional view of one embodiment of the agitator of this invention, obtained from Section A-A.
Figure 5:
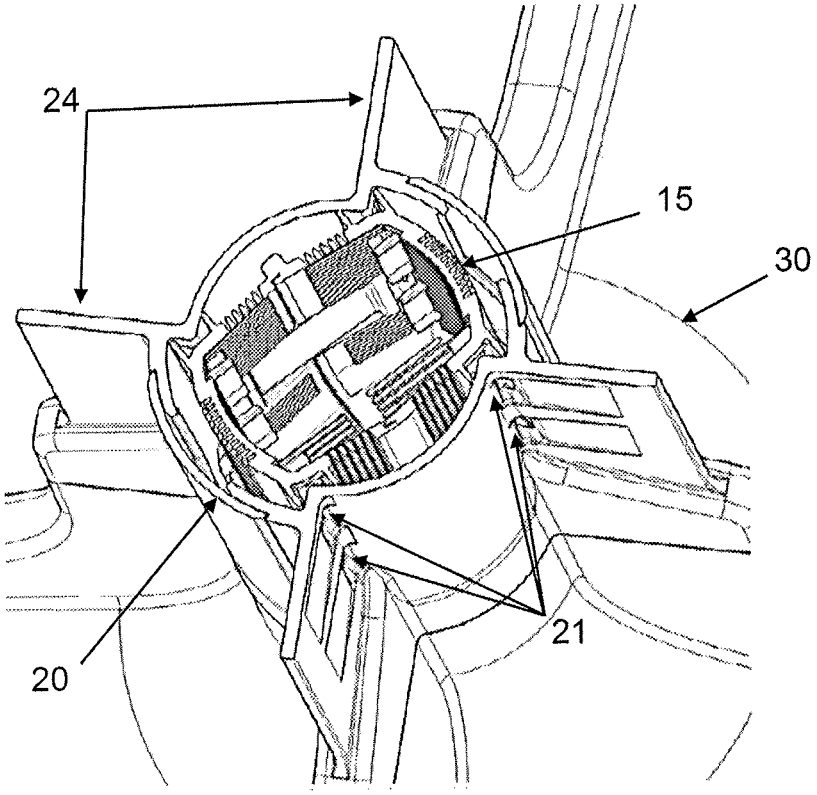
FIG. 5 shows a cross-sectional perspective view of one embodiment of the agitator of this invention, representing a portion of the elongated member and of a filtration element mounted therein, both in cross-section.

Such projections 24, in one embodiment of this invention, as shown in FIG. 4, comprise a flat geometry which, if observed in a cross section along the length of the elongated body 20, has a direction ranging from 0° to 89° with respect to a plane SS orthogonal to the axis of rotation of the agitator 10 and passing through the center of rotation TC of the agitator 10, i.e., such projections 24 may have angles along their length, depending on the design preferences. A number of other constructional variants that meet these constructive characteristics of the projections 24 are shown in FIGS. 8*a* through 8*d*.

Figure 8A:
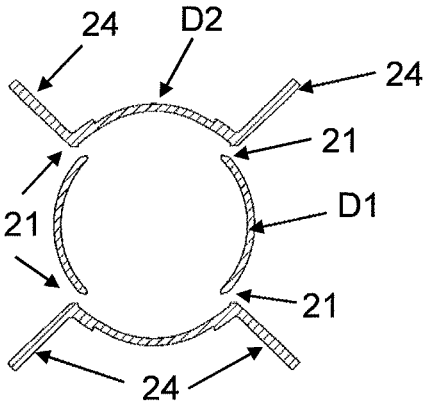
FIGS. 8*a* to 8*e* depict diverse variations of the cross section of the elongated body of the agitator of this invention perpendicular to the axis of rotation of the agitator, all carrying with it the same central technical effect of positioning the intake opening of the washing liquid oriented according to the alternating rotational movement of the mechanical agitator.

More precisely, the constructive variant shown in FIG. 8*a* shows a cross-section of the elongated body 20 whose peripheral area is formed by two circumscribed circles of different diameters D1, D2, each of the diameters D1, D2 occupying, in an interlocking fashion, a quarter of the peripheral portion of the cross-section of the elongated body. In this embodiment the very difference between the diameters D1 and D2 defines the position of four openings 21, these being arranged one quadrant within another in the cross section of the elongated body 20. Furthermore, projections 24 are located next to each of the openings, in the portions having a diameter D2, so as to concentrate the washing liquid in the area next to the opening 21, optimizing the absorption thereof to the inner area of the agitator 10.

Figure 8B:
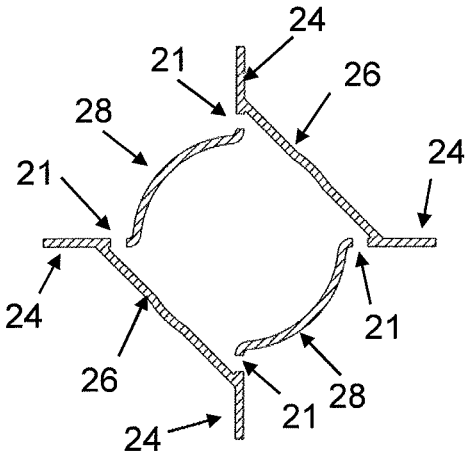

The constructive variant shown in FIG. 8*b* comprises the peripheral area formed by two flat sides 26 and two arched sides 28, each of the portions being located in an interlocking fashion within each quarter of the peripheral portion. In a manner analogous to the constructive variant of FIG. 8*a*, the constructive variant of FIG. 8*b* also comprises projections 24 located on the edges of the flat sides 26 so as to concentrate the washing liquid in the area next to the opening 21, located next to the ends of the arched portions 28, optimizing the absorption thereof into the inner area of the agitator 10.

Figure 8C:
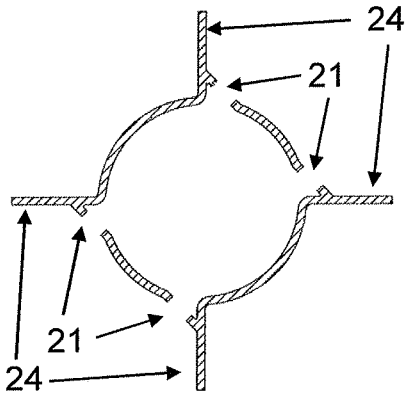

The constructive variant shown in FIG. 8*c* comprises a cross section perpendicular to the axis of rotation of the agitator 10 comprising circular geometry, with projections 24 located from the outer walls, offset at 90° from one another, comprising openings 21 located near the base of each of the projections 24.

Figure 8D:
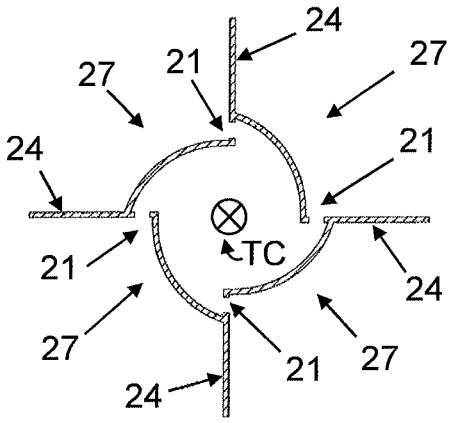

The constructional variant shown in FIG. 8*d* comprises the peripheral area comprising each quadrant provided with an arched portion 27, such arched portion 27 being an arc segment offset toward the center of rotation TC of the agitator 10. Such an arrangement is intended to direct the flow of the washing liquid towards the openings 21, from the respective projections 24. The arched portions may all be of the same diameter, different diameters or further defined by spiral segments. More precisely, the portion contained in each quadrant of the cross section comprises an end provided with a projection 24 and an end next to the opening 21.

Figure 8E:
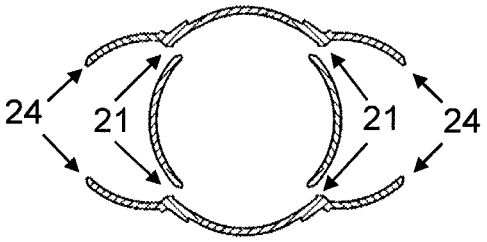

In one embodiment of this invention, the outer projections 24 are arched, comprising in this embodiment the openings 21 located adjacent to the base thereof. The purpose of this geometry is to utilize the arching of the outer projections 24 to guide the washing liquid towards the openings 21, further optimizing the absorption efficiency of the flow F of the washing liquid into the agitator 10 and, consequently, optimizing the filtration efficiency due to the increase of liquid passing through the filtration element 15. An example of this embodiment can be seen in FIG. 8*e*.

As can be seen in FIG. 1, one embodiment of the agitator 10 comprises a plurality of openings 21, in order to cover the largest possible area and thus absorb as much washing liquid as possible. In a similar manner, and also shown in FIG. 1, said plurality of openings 21 are arranged in pairs, defining two rows along the elongated body 20, the openings 21 of each row being oriented in opposite directions, i.e., oriented in accordance with the tangential speed $v_{tan}$ at each moment of the alternating rotary movement M, in order to pick up washing liquid at all times during the operation of the mechanical agitator.

Figure 9:
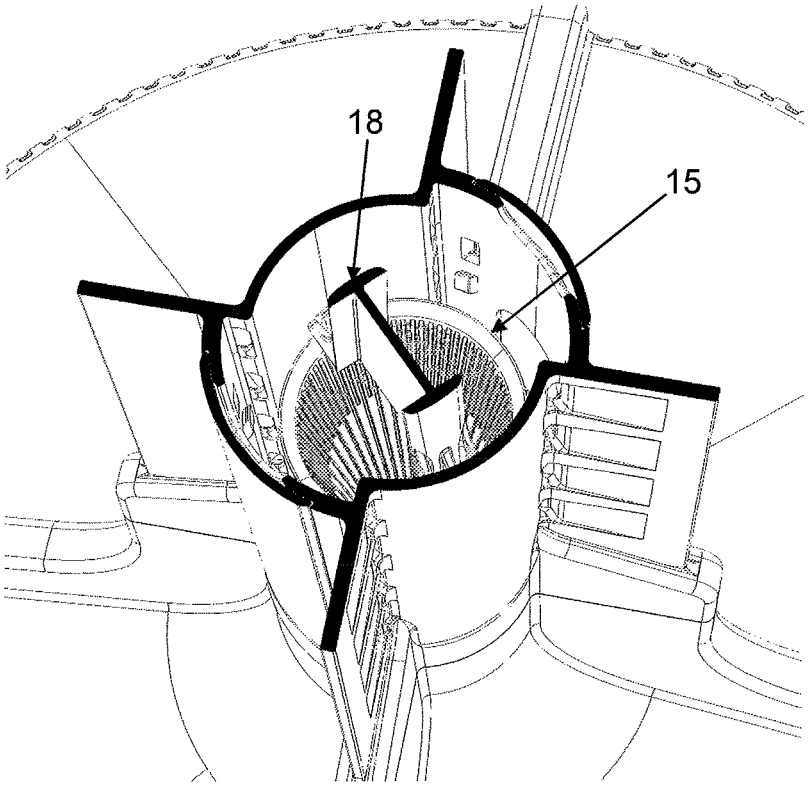
FIG. 9 shows a cross-sectional view of the agitator of this invention, in the condition that a conventional filtration element is mounted therein.
Figure 10A:
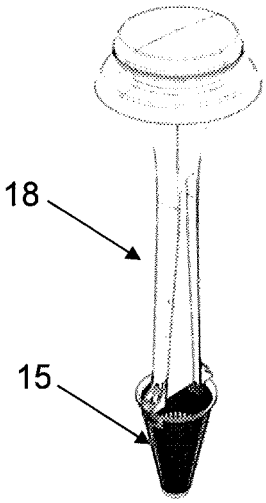
FIGS. 10*a* and 10*b* depict two filtration element embodiments, which is shown in FIG. 10*a* a conventional filtration element and that shown in FIG. 10*b* is a filtration element sized to comprise openings coincident with the openings of the agitator of this invention.
Figure 10B:
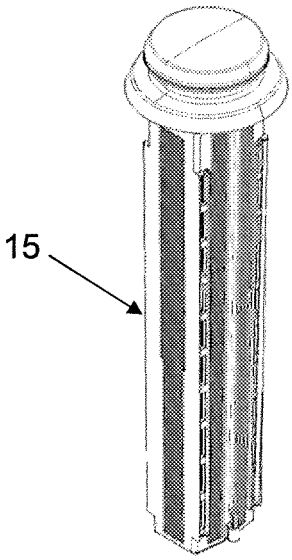

As already discussed, the mechanical agitator 10 comprises a filtration element 15 mounted therein for performing the step of filtering and retaining lint and other objects and particles unsuitable for making up the medium of the washing liquid. The filtration element may be of any type from the Prior Art, for example the model shown in FIGS. 9 and 10*a*, in which the filtration element 15 is fixed to the end of a rod 18.

Preferably, it is designed to occupy the entire area for absorption of the washing liquid, the agitator openings 21 being dimensioned and positioned so as to be adjacent to the inlets of the filtration element 15. Thus, the optimized flow and immediate direction of the washing liquid entering the agitator through a flow F for a filtration element 15 represents an optimization in the efficiency of filtration, since the amount of washing liquid which passes through the filtration element 15 is increased as compared to Prior Art solutions.

In still another embodiment of this invention, the agitator base 30 comprises a plurality of radial openings 31, preferably located along the radial periphery of the base 30. The openings 31 have the function of increasing the outlet flow of the filtered washing liquid from the interior of the agitator to the washing area inside the washing basket of the laundry washing machine. In this way, the flow of the washing liquid is intensified inside the washing basket and, consequently, the amount of liquid passing through the filtration element is also intensified, increasing the filtration efficiency and improving the washing result.

Figure 3:
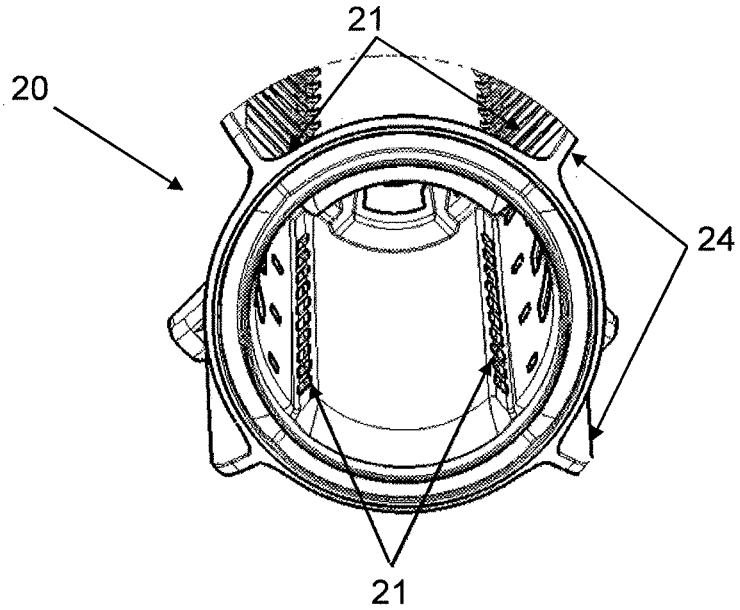
FIG. 3 shows a lower portion of the elongated body of the agitator, seen in perspective, showing the position of the openings in the inner area of said elongated body.

As can be seen in the embodiment of FIG. 3, the openings 21 are located internally to enable them to be mounted adjacent to the inlet of a filtration element 15 housed therein. Preferably, the inlets of the filtration element 15, as well as the agitator openings 21, also comprise a plane P defined by the intersection of at least two areas of the edge of the opening at an angle β, relative to a tangential velocity vector $v_{tan}$ of the alternating rotational movement M of the agitator, the angle β being defined between 1° and 90°. In this way, the aim is to optimize the admission of the washing liquid to the internal area of the filtration element 15.

Figure 11:
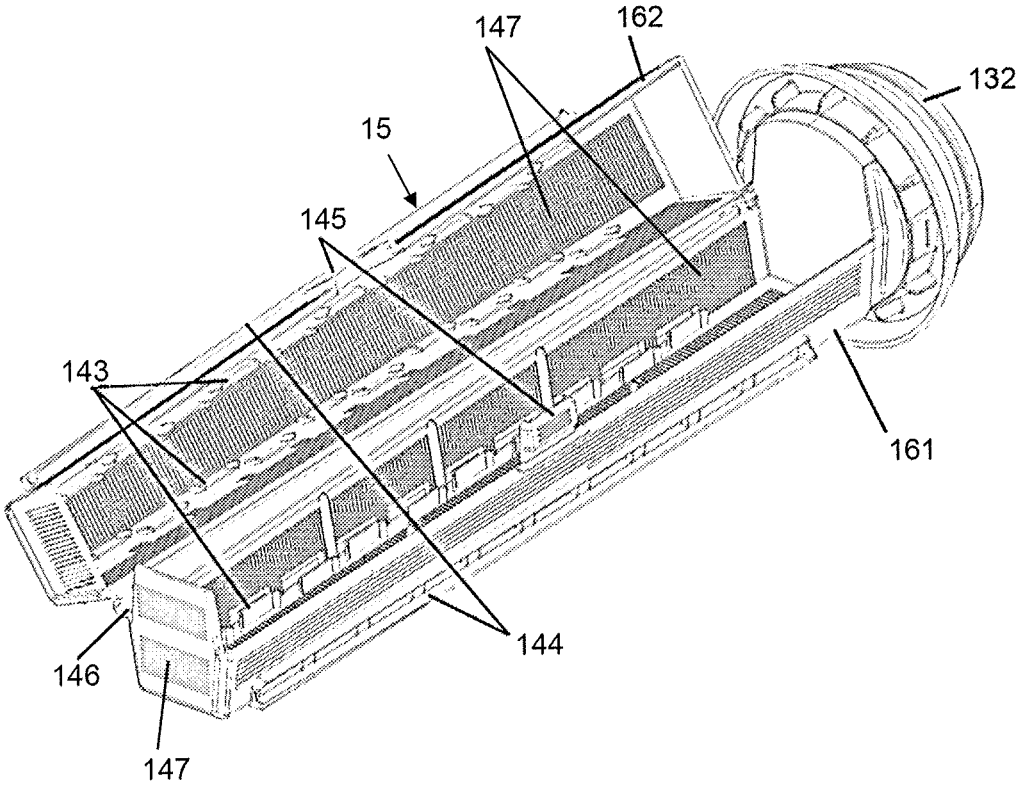
FIG. 11 shows a filtration element 15, in one embodiment of this invention, comprising a first portion 161 and a second portion 162 pivotally mounted to each other by a hinge 146, being lockable in the closed position by means of a locking member 145.

In one embodiment of the invention, the filtration element 15 further comprises at least one washing liquid intake opening 144 located along its length, oriented in accordance with the rotational directions M of the mechanical agitator 10, as can be seen in FIG. 11.

More precisely, the inlet openings 144 have the functionality of increasing the inlet of the washing liquid to the inner filtration element area 15 as a consequence of the rotational movement M of the mechanical agitator 10, i.e., the opening is arranged so that the washing process liquid naturally passes through the intake openings 144 when the filtration element 15 moves along with the agitator 10.

In particular, the position of the opening 144 of the filtration element 15 is delimited by a plane P defined by the intersection of at least two areas of the edge of the intake opening 144, forming an angle β with respect to a tangential velocity vector $v_{tan}$ of the rotational movement M of the agitator 10, starting from said opening 144. Thus, the opening 144 is located offset at an angle β defined between 1° and 90°, preferably 30° to 90°, and more preferably 90°, exactly as defined for the opening 21.

In one embodiment of the invention, filtration element 15 comprises a split body provided with a first portion 161 and a second portion 162 that are associable with each other, as shown in FIG. 11, wherein the filtration element 15 is shown in the open state, the first portion 161 and a second portion 162 being connected by means of a hinge 146. It should be noted, however, that any other form of movable association of components (e.g., fittings, tabs, rails, or the like) could be adopted without this altered the inventive concept of this invention.

Further, to ensure that the filtration element 15 remains in the closed position during its operation, in one embodiment of the invention, the first portion 161 and the second portion 162 of the filtration element 15 are held locked together by a locking member 145, which may be any one defined in the Prior Art, such as straps, fittings or correlated items, as long as it enables the opening and closing of the filtration element 15 repeatedly, enabling cleaning by the user.

Figure 12:
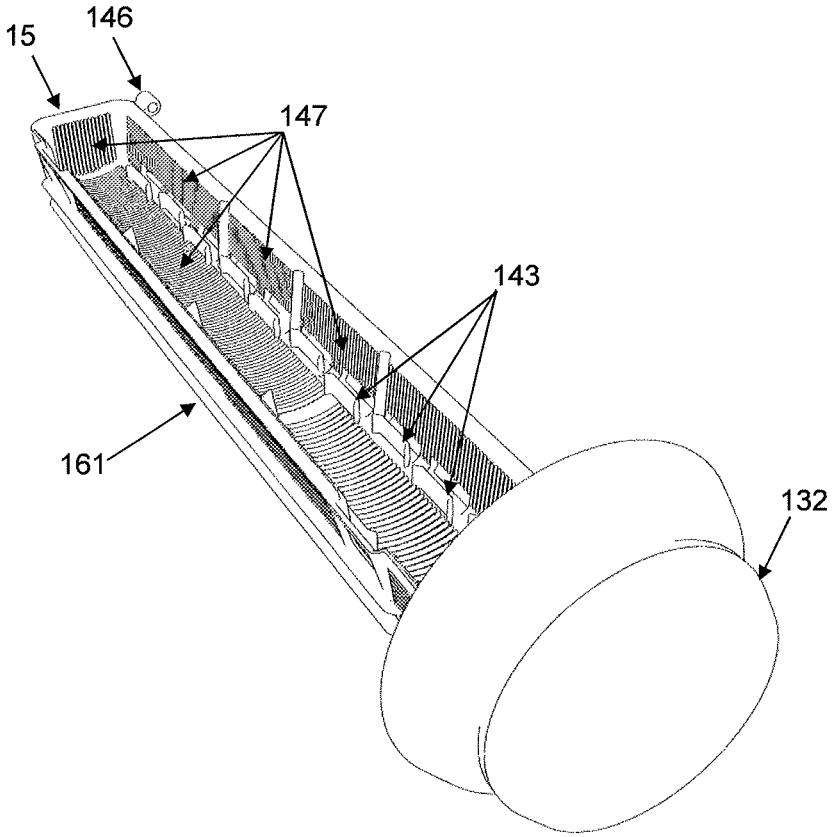
FIG. 12 shows a view in perspective of an embodiment of the filter of this invention, as shown in FIG. 11, however representing the first portion 161 of the filter, in a cleaning or pre-assembly condition of the filtration element 15.
Figure 13:
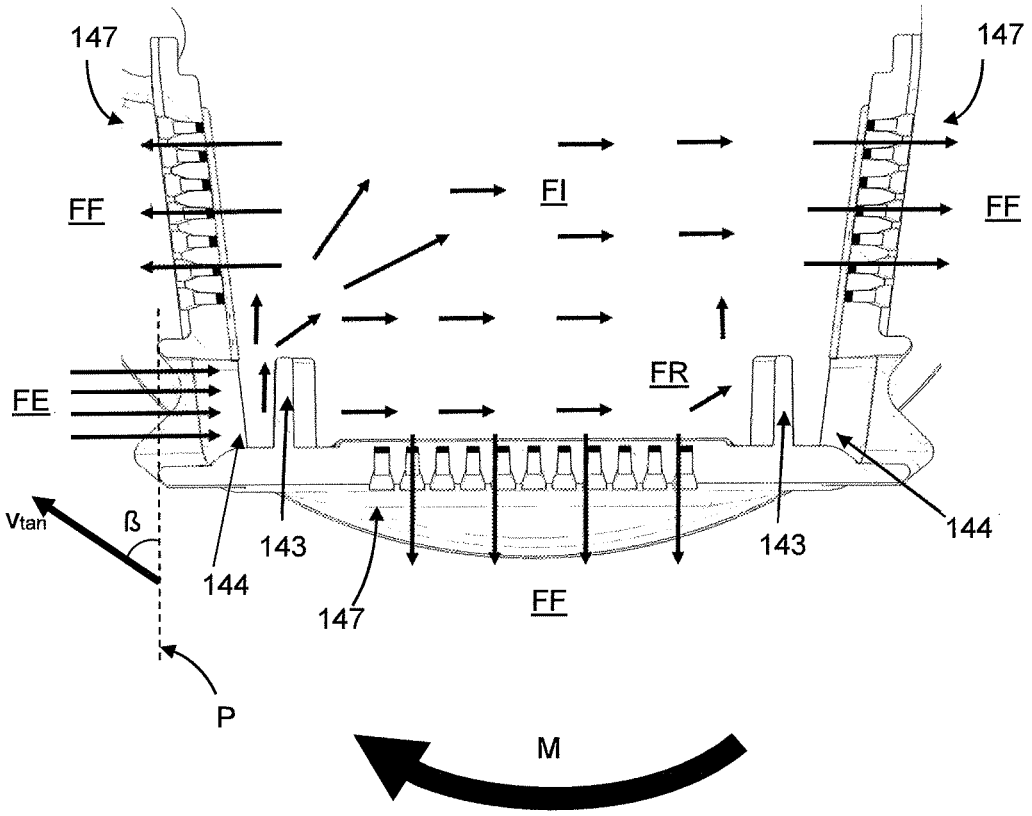
FIG. 13 shows a cross-sectional view of a lower area of the filter 15, according to one embodiment of this invention, showing the flow lines of the washing liquid from its intake through the openings 144, to its outlet in the filter areas 147 of the filtration element 15.

In one embodiment of this invention, in order to optimize the retention of the washing liquid within the filtration element 15, the retaining vanes 143 are used and located immediately behind each of the intake openings 144, as shown in FIGS. 11, 12 and 13.

FIG. 13 further shows a detailed cross-sectional view of a portion of the filtration element 15, indicating the path of movement of the washing liquid through the interior of the filtration element 15, thanks to the use of the vanes 143, by means of arrows indicative of the direction of the liquid.

More precisely, the openings 144 absorb an intake flow FE which is encountered immediately upon entering the filtration element 15 with a surface of the vane 143. The vane 143, in turn, directs the washing liquid into the filtration element 15, defining an internal flow FI that moves within the filter and, upon moving into the intake port 144, generates a return flow FR directed back into the internal flow FI by means of the vanes 143.

In this way, the internal flow FI finds it easy to leave the inner area of the filtration element 15 solely by means of the filtering surfaces 147, generating the filtration flows FF, guiding the washing liquid to the external area to the filtration element 15, returning to the washing basket, and holding the particles suspended in the washing liquid on the filtering surface 147, inside the filtration element 15.

Additionally, in one embodiment of this invention, the vanes 143 comprise a geometry optimized to enable/facilitate the input stream FE and to bar the return flow FR. An example of geometry of this invention, as shown in FIG. 15, consists of retaining vanes 143 with geometry provided with a flat portion 431 and two deflecting portions 432, the flat portion 431 being placed in the area more to the center of the length of the vane 143 and the deflecting portions 432 placed at the ends of the blade 143.

Figure 14:
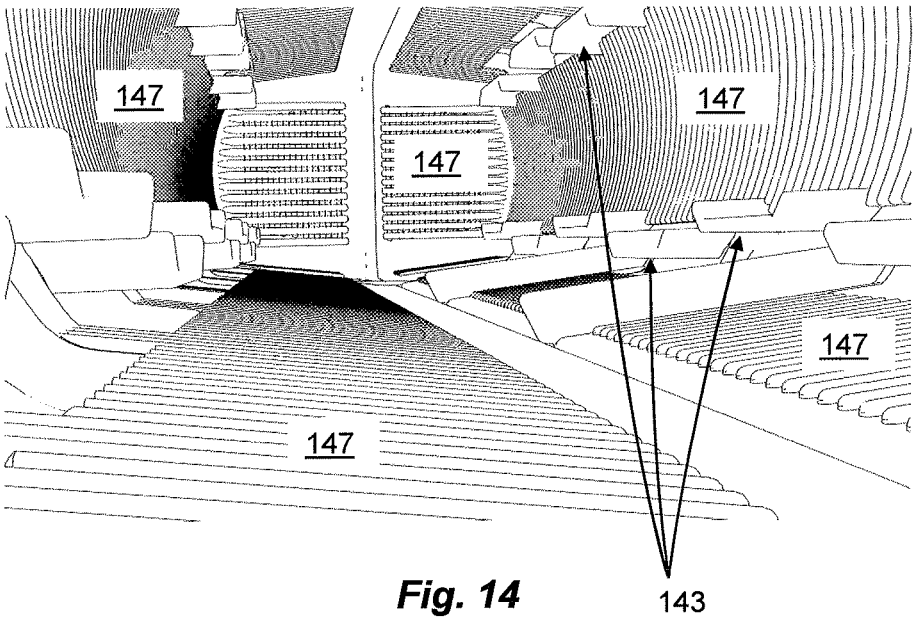
FIG. 14 shows a view of the interior of a filtration element 15 according to an embodiment of this invention in which the movement and filtering space of the washing liquid is represented as well as the arrangement of the retaining vanes 143 and filter surfaces 147.
Figure 15:
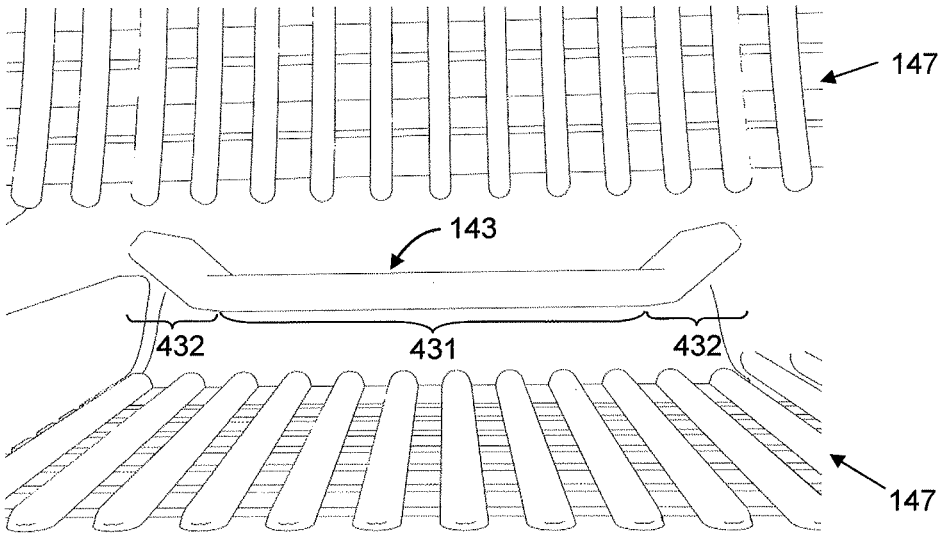
FIG. 15 shows a detailed view of a retaining vane 143, according to an embodiment of the filtration element 15 of this invention.

Further, as shown in FIG. 15, and as can also be seen in FIGS. 11, 12 and 14, the retaining vanes 143 comprise the deflecting portions 432 defined by an arch directed toward the inner area of the filtration element 15, generating a rounding that conducts the flow of the intake stream FE into the filtration element 15, and a kind of shell for holding fluid which tends to leave the inner area of the filtration element 15 by means of the intake openings 144, forming a return flow FR.

In order to facilitate the removal of the filtration element 15, in one embodiment of this invention, the filtration element 15 is associated with a handle 132, which makes it possible to attach a handle for the user so as to facilitate removal of the filter assembly 20 as a whole from the interior of the mechanical agitator 142.

In still another embodiment of this invention, the filter comprises portions with through openings of different sizes, defining multiple levels of filtration, i.e., enabling different levels of filtration to be performed in each area of the filter surface 147, depending on the desired design characteristics.

Notwithstanding the description of the particular embodiments above, this invention may be embodied differently and may exhibit modifications in its form of implementation, so that the scope of protection of the invention is limited only by the content of the appended Claims, including all possible equivalent variations.

The invention claimed is:

1. A laundry washing machine comprising:

a washing basket configured to be loaded through an upper end thereof; and an agitator located inside the washing basket and comprising:

a base;

a filtration element located in a chamber within the agitator; and an elongated hollow body having at least one opening for the admission of washing liquid into the chamber;

wherein the at least one opening lies in a plane that intersects at least two edge areas of the opening forming an angle with respect to a tangential velocity vector, of a rotational movement of the agitator starting from said opening, the angle being defined between 15° and 90°.

2. The laundry washing machine according to claim 1, wherein the angle is defined between 30° and 90°.

3. The laundry washing machine according to claim 1, wherein the elongated hollow body of the agitator comprises external projections that are oriented, as observed in a transverse section along the length of the elongated hollow body, at a direction ranging from 0° to 89° relative to a plane that is orthogonal to an axis of rotation of the agitator and passes through a center of rotation of the agitator.

4. The laundry washing machine according to claim 1, wherein the elongated hollow body of the agitator comprises arched external projections, and the opening is located adjacent to the base of an inner area of the external projections projection.

5. The laundry washing machine according to claim 1, wherein the elongated hollow body of the agitator has a cross section perpendicular to the axis of rotation of the agitator with a peripheral area formed by two radially opposed inner wall segments extending along an inner circle having a first diameter, and two radially opposed outer wall segments extending along an outer circle having a second diameter that is greater than the first diameter, the inner circle and outer circle being circumscribed, wherein each of the two outer wall segments radially overlaps an adjacent edge area of each inner wall segment and the two outer wall segments and the two inner wall segments each occupies one quarter of the peripheral portion of the cross-section of the elongated hollow body.

6. The laundry washing machine according to claim 5, wherein the the at least one opening comprises a respective opening formed between each outer wall segment and the adjacent edge area of each inner wall segment, and a respective projection extends radially from each outer wall segment at each respective.

7. The laundry washing machine according to claim 1, wherein the elongated hollow body of the agitator has a cross section perpendicular to the axis of rotation of the agitator with a peripheral area formed by two flat sides and two arched sides, each of the flat sides radially overlapping an adjacent edge area of each flat side in each quarter of the peripheral portion.

8. The laundry washing machine according to claim 7, wherein the elongated hollow body of the agitator comprises projections located on the flat side and a respective opening is located adjacent to a respective end of a respective arched side.

9. The laundry washing machine according to claim 1, wherein the elongated hollow body of the agitator has a cross section perpendicular to the axis of rotation of the agitator with a peripheral area in which each quadrant comprises an arched portion offset toward a center of rotation (TC) of the agitator.

10. The laundry washing machine according to claim 9, wherein each cross-sectional portion comprises an end provided with a projection and an end next to a respective opening.

11. The laundry washing machine according to claim 9, wherein the arched portions are all of the same diameter.

12. The laundry washing machine according to claim 1, wherein the agitator comprises a plurality of openings located along its length.

13. The laundry washing machine according to claim 12, wherein the agitator comprises pairs of rows of openings along the elongated hollow body, the openings of each row being oriented in opposite rotational directions of the agitator.

14. The laundry washing machine according to claim 1, wherein the filtration element comprises filtering surfaces and intake openings, and wherein the at least one opening of the agitator comprises a plurality of openings adjacent to respective intake openings of the filtration element.

15. The laundry washing machine according to claim 1, wherein the base of the agitator comprises a plurality of openings in the base.

16. The laundry washing machine according to claim 15, wherein the openings in the base are located in a radial periphery of the base.

17. The laundry washing machine according to claim 14, wherein the openings and the intake openings of the filter element are aligned with the direction of the tangential velocity vector of the movement of the agitator.

* * * * *